US006817934B2

(12) United States Patent
Takatoh et al.

(10) Patent No.: US 6,817,934 B2
(45) Date of Patent: Nov. 16, 2004

(54) ABRASIVE MOLDING AND ABRASIVE DISC PROVIDED WITH SAME

(75) Inventors: Shuji Takatoh, Sagamihara (JP); Yoko Honma, Yokohama (JP); Mutsumi Asano, Sagamihara (JP)

(73) Assignee: Tosoh Corporation, Yamaguchi (JP)

( * ) Notice: Subject to any disclaimer, the term of this patent is extended or adjusted under 35 U.S.C. 154(b) by 668 days.

(21) Appl. No.: 09/895,391

(22) Filed: Jul. 2, 2001

(65) Prior Publication Data

US 2002/0014309 A1 Feb. 7, 2002

(30) Foreign Application Priority Data

Jul. 3, 2000 (JP) ..... 2000-205579

(51) Int. Cl.[7] ..... B24D 3/00
(52) U.S. Cl. ..... 451/539; 451/526
(58) Field of Search ..... 451/526, 527, 451/539, 540, 546, 548, 550; 51/298, 307, 308, 309

(56) References Cited

U.S. PATENT DOCUMENTS 6,171,180 B1 * 1/2001 Koutny, Jr. et al. ..... 451/287
6,328,644 B1 * 12/2001 Kuramochi et al. ..... 451/526
6,575,824 B2 * 6/2003 Kuramochi et al. ..... 451/527
6,659,846 B2 * 12/2003 Misra et al. ..... 451/41
6,705,935 B2 * 3/2004 Kuramochi et al. ..... 451/527

FOREIGN PATENT DOCUMENTS

| | | |
|---|---|---|
| JP | 4-256581 | 9/1992 |
| JP | 10-264015 | 10/1998 |
| JP | 10-337669 | 12/1998 |
| JP | 11-104952 | 4/1999 |

* cited by examiner

*Primary Examiner*—Robert A. Rose
(74) *Attorney, Agent, or Firm*—Nixon & Vanderhye P.C.

(57) ABSTRACT

An abrasive molding consisting essentially of inorganic particles having an average particle diameter in the range of 0.005 μm to 0.3 μm, and having a relative density in the range of 45% to 90%, provided that pores having a diameter of at least 0.5 μm are excluded from the molding. The abrasive molding is used for polishing a material to be polished by using a polishing liquid, preferably water or an aqueous solution of an alkali metal hydroxide, which does not contain a loose abrasive grain.

14 Claims, No Drawings

ABRASIVE MOLDING AND ABRASIVE DISC PROVIDED WITH SAME

BACKGROUND OF THE INVENTION (1) Field of the Invention

This invention relates to an abrasive molding and an abrasive disc provided with at least one abrasive molding, which are used in a process for polishing or chemicomechanically polishing substrate materials, for example, for substrates such as a silicon wafer, an oxide substrate, a chemical compound semiconductor substrate, a glass substrate and a silica glass substrate and a ceramic substrate, and optical materials such as an optical lens and a spectacle lens.

(2) Description of the Related Art

With the advance of industries including an optical industry and an electronic industry, a higher precision and other requirements for processing materials for a magnetic disc, a semiconductor substrate, a single crystal material, an optical material and other substrate materials, are becoming severe. That is, there is an increasing demand for obtaining higher smoothness and flatness by polishing the material surface in the finishing process thereof.

A loose abrasive machining has been widely employed in the conventional polishing process, wherein a substrate material is polished with a polishing pad made of nonwoven fabric or suede while a polishing liquid containing a loose abrasive grain is continuously applied onto the polishing surface. The loose abrasive grain is composed of, for example, diamond, aluminum oxide, silicon oxide, cerium oxide, zirconium oxide, iron oxide, titanium oxide, manganese oxide, silicon carbide or zirconium silicate.

The conventional polishing process using a loose abrasive grain has a problem such that a polishing pad used has a very low modulus and thus the substrate material is not uniformly abraded over the entire surface to be polished, i.e., the corner portions of the material surface are excessively abraded upon polishing.

If a polishing pad is used together with a polishing liquid containing no loose abrasive grain, such as water having an adjusted pH value, the polishing power is too weak to complete the polishing within a reasonably short time. To cope with this problem, a salient amount of a loose abrasive grain must be incorporated in a polishing liquid, but, the incorporation of a salient amount of a loose abrasive grain leads to production of a salient amount of a waste polishing liquid containing a loose abrasive grain. Therefore, the efficiency of polishing, the equipment for waste disposal and the environmental pollution with the waste polishing liquid must be considered.

To solve the above-mentioned problems, a proposal has been made in Japanese Unexamined Patent Publication (hereinafter abbreviated to "JP-A") No. H4-256581 wherein a synthetic abrasive stone comprising abrasive grain particles bonded with a synthetic resin binder is used. It is described in this patent publication that the problem of non-uniform abrading can be mitigated or avoided.

Further, vitrified grinding stone comprising abrasive grain particles bonded with an inorganic binder, and a metal bonded grinding stone comprising abrasive grain particles bonded with a metal binder have been proposed. It is said that the problem of non-uniform abrading can be mitigated or avoided by using these inorganic substance-bonded grinding stone.

However, the use of these binders causes another problem such that the abrasive stone tends to be clogged with the binder, leading to reduction of polishing performance and efficiency. Further, it is very difficult to uniformly disperse fine abrasive grain particles In an abrasive stone bonded with the synthetic resin binder or the metal or other inorganic substance binder, in the manufacturing process, and surface defects such as worn marks are liable to be caused in a manner similar to the case where a large abrasive grain Is used. If the amount of fine abrasive grain particles is reduced to enhance uniform dispersion of the grain particles, the rate of polishing, and the polishing performance and efficiency are undesirably reduced. Further, the use of binders such as synthetic resins, metal, and inorganic binders such as glass materials containing an alkali metal and other impurities, occasionally causes contamination of a polished material with impurities from the binders during the polishing process depending upon the abrading conditions.

An abrasive molding predominantly comprised of an abrasive silica grain is described in JP-A H10-264015. The following findings are described In this patent publication.

(1) The abrasive molding has a modulus higher than that of a polishing pad, and thus, excessive abrasion of the corner portions of the material surface occurring upon polishing can be minimized, and the substrate material can be uniformly abraded over the entire surface to be polished.

(2) The abrasive molding has a rough surface composed of silica particles, among which a multiplicity of fine pores are formed, and therefore, a problem such that an abrasive molding tends to be clogged during polishing can be minimized or avoided (3) The abrasive molding does not contain a synthetic resin or other binder, and hence the abrasive molding exhibits high thermal resistance and chemical resistance in the polishing process. Therefore, a high polishing efficiency can be obtained by using an appropriate polishing liquid in a temperature range up to approximately the boiling point.

(4) The abrasive molding is composed of silica particles used as abrasive grain, and the molding does not contain a binder, and thus, the abrasive molding does not cause contamination of a polished material.

(5) The smooth polished surface and the rate of polishing achieved with the abrasive molding are of the same level as or higher level than those of the conventional polishing processes using a polishing pad. The smooth finish and the rate of polishing are not decreased with a lapse of polishing time.

(6) The molding abrasive has a rough surface composed of silica particles. The hard and fine abrasive surface of the silica particles are brought into direct contact with a material to be polished, and hence, a polishing liquid which does not contain loose abrasive grains can be used for polishing with the abrasive molding.

(7) Even if an abrasive loose grain is used in combination with the abrasive molding, a high rate of polishing can be achieved with a polishing liquid containing the abrasive loose grain at a low concentration, as compared with the conventional polishing process using a polishing pad.

A grinding stone consisting of sintered body of inorganic abrasive grains is described in JP-A H10-337669. It is taught in this patent publication that good results similar to those obtained by the abrasive molding of JP-A H10-264015, can be achieved by suitably selecting the material and particle size of abrasive grains, and the porosity and water absorption of the grinding stone. However, the polished surface of silicon wafer as an example of the material to be polished exhibits a surface roughness of approximately 3 nm as expressed in terms of center line mean surface roughness. The rate of polishing is not referred to in this patent publication.

In the above-stated JP-A H10-264015, the surface roughness of a polished silicon wafer is expressed in terms of those values as measured by using a universal surface tester SE-3C available from Kosaka kenkyusho K. K. But, we found some difficulty in accurately measuring the surface roughness of a polished surface having a very low roughness by the same surface tester. Thus, we repeated the measurement of surface roughness of the polished surface obtained by the abrasive molding described in JP-A H10-264015, by using an atomic force microscope (AFM; "SPI3600" available from SII Co.), and found that the polished surface has a center line mean surface roughness of 0.6 nm to 1 nm, namely, the surface roughness is better than that of the polished surface obtained by the grinding stone described in JP-A H10-337669.

The abrasive molding composed of silica particles used as abrasive grain, described in JP-A H10-264015, is suitable for polishing machining process or chemicomechanical polishing process (hereinafter abbreviated to "CMP process") for substrate materials such as a silicon wafer, an oxide substrate, a chemical compound semiconductor substrate, a glass substrate, a crystalline silica glass substrate and a ceramic substrate, and optical materials. But, the polishing performance attained varies depending upon the material to be polished, and thus, full consideration must be given for selection of material of abrasive grain used and particle size thereof, depending upon the particular material to be polished.

In view of the foregoing state of the prior art, an abrasive molding has been eagerly desired, which is capable of polishing a material to be polished, at a high polishing rate by using a polishing liquid containing no abrasive grain, to give a smooth polished surface having a high surface precision, and which is characterized by an enhanced polishing efficiency and a reduced polishing cost.

SUMMARY OF THE INVENTION

A primary object of the present invention is to provide an abrasive molding, which is suitable for polishing machining process or CMP process for substrate materials such as a semiconductor substrate, an oxide single crystal substrate, a glass substrate, a crystalline silica glass substrate and a ceramic substrate, and for optical materials for which a high precision machining is required, and further to provide a polishing disc provided with at least one of the abrasive molding.

More specifically, a primary object of the present invention is to provide an abrasive molding and a polishing disc provided with at least one abrasive molding; which abrasive molding is capable of polishing a material to be polished with a high efficiency by using a polishing liquid containing no loose abrasive grains or containing a minor amount of loose abrasive grains, and thus, the polishing cost is reduced and the problem of waste polishing liquid containing loose abrasive grains is mitigated; and is capable of polishing the material with a higher efficiency to give a smooth polished surface of the same level as or higher level than those of the conventional polishing processes using a polishing pad.

In accordance with the present invention, there is provided an abrasive molding for polishing a material to be polished by using a polishing liquid containing no loose abrasive grain, said molding consisting essentially of inorganic particles having an average particle diameter in the range of 0.005 $\mu$m to 0.3 $\mu$m, and said molding having a relative density in the range of 45% to 90%, provided that pores having a diameter of at least 0.5 $\mu$m are excluded from the molding.

In accordance with the present invention, there is further provided an abrasive disc for polishing a material to be polished by using a polishing liquid containing no loose abrasive grain, said abrasive disc comprising at least one abrasive molding fixed to a supporting auxiliary; said abrasive molding comprising inorganic particles having an average particle diameter in the range of 0.005 $\mu$m to 0.3 $\mu$m, and said molding having a relative density in the range of 45% to 90%, provided that pores having a diameter of at least 0.5 $\mu$m are excluded from the molding.

DESCRIPTION OF THE PREFERRED EMBODIMENTS

Characteristics of Abrasive Molding

The abrasive molding of the present invention is used for polishing a material to be polished by using a polishing liquid containing no loose abrasive grain The abrasive molding consists essentially of inorganic particles having an average particle diameter in the range of 0.005 $\mu$m to 0.3 $\mu$m, and the abrasive molding has a relative density in the range of 45% to 90%, as measured on an abrasive molding from which pores having a diameter of at least 0.5 $\mu$m are excluded.

By the term "polishing liquid containing no loose abrasive grain" herein used, we mean an aqueous solution or an organic solution, which does not contain ordinary abrasive grains including, for example, diamond, aluminum oxide, silicon oxide, cerium oxide, zirconium oxide, manganese oxide, titanium oxide, magnesium oxide, iron oxide, chromium oxide and silicon carbide. If desired, the polishing liquid containing no loose abrasive grain may contain a polishing promoter such as an acid, an alkali, a chelating agent, an oxidizing agent and a reducing agent. As specific examples of the polishing liquid containing no loose abrasive grain, there can be mentioned water; an aqueous solution containing an inorganic acid such as hydrochloric acid, sulfuric acid or nitric acid; an aqueous solution containing an organic acid such as formic acid, acetic acid, oxalic acid, malonic acid, quinaldinic acid, citric acid, tartaric acid or succinic acid; an aqueous solution containing an alkali metal hydroxide such as lithium hydroxide, sodium hydroxide, potassium hydroxide or rubidium hydroxide; an aqueous solution containing an alkaline earth metal hydroxide such as calcium hydroxide; an aqueous ammonia solution; an aqueous solution containing a chelating agent such as ethylenediaminetetraacetato complex (EDTA): an aqueous solution containing an oxidizing agent such as hydrogen peroxide or potassium permanganate; and an aqueous solution containing a reducing agent such as sodium sulfite or potassium sulfite. Of these, an aqueous solution containing an alkali metal hydroxide or an alkaline earth metal hydroxide is preferable because an etching effect is imparted to a material to be polished and hence the polishing efficiency is further enhanced. Water also is preferable from an economical viewpoint and a waste liquor disposal.

The inorganic particles can appropriately chosen depending upon the particular material to be polished. More specifically, a suitable inorganic particle can be chosen, for example, depending upon physical properties such as hardness and toughness of the material to be polished and chemical properties such as chemical reactivity thereof, and the surface precision, flatness and rate of polishing, which are required for a polished material.

As specific examples of the inorganic particles, there can be mentioned particles of oxides such as aluminum oxide, silicon oxide, cerium oxide, zirconium oxide, manganese oxide, titanium oxide, magnesium oxide, iron oxide, chromium oxide and yttrium oxide; and non-oxides such as silicon carbide, boron carbide and boron nitride. Of these, silicon oxide, cerium oxide and zirconium oxide are preferable. The zirconium oxide may be used in the form of a solid solution with a stabilizer such as rare earth oxides such as yttrium oxide, scandium oxide, indium oxide and cerium oxide, or alkaline earth oxides such as magnesium oxide and calcium oxide. These inorganic particles may be used either alone or as a combination of at least two thereof.

The abrasive molding of the present invention is a three-dimensional structure consisting essentially of the above-mentioned inorganic particles, of which polishing surface is directly contacted with the surface to be polished.

The inorganic particles constituting the abrasive molding have an average particle diameter of 0.005 μm to 0.3 μm. When the particle size is in this range, a smooth polished surface of an acceptable precision can be obtained with a high efficiency. In general, in the case where polishing is conducted by using a polishing liquid containing no loose abrasive grain, the surface precision of a polished surface is enhanced with a decrease of the average particle diameter of the inorganic particles. However, powdery inorganic materials having an average primary particle diameter smaller than 0.005 μm are not available or are difficult to prepare, and thus, an abrasive molding comprised of inorganic particles having an average particle diameter smaller than 0.005 μm is difficult to make. In contrast, if the average particle diameter of the particles constituting the abrasive molding is larger than 0.3 μm, a material to be polished tends to be damaged during polishing.

The average particle diameter of the inorganic particles constituting the abrasive molding is determined by observing particles on the abrasive molding by a scanning electron microscope (SEM), and calculating the diameter of observed particles by an interseptive method, as mentioned below.

The abrasive molding of the present invention has a relative density in the range of 45% to 90%, provided that pores having a diameter of at least 0.5 μm are excluded from the molding. In other words, part of the abrasive molding, which part is composed of the inorganic particles and fine pores having a diameter smaller than 0.5 μm, has a relative density of 45% to 90%. Preferably the relative density is 45% to 75%. If the relative density is smaller than 45%, the abrasive molding tends to be worn off in a salient amount and the fallen particles cause surface defects such as scratches. In contrast, if the relative density is larger than 90%, a polished surface is marred by the direct contact with the abrasive molding. When the relative density is within the above range, a smooth polished surface having an acceptable precision can be obtained.

The relative density of the abrasive molding, from which pores having a diameter of at least 0.5 μm are excluded, is determined by the method, mentioned below, namely, by the steps of observing the surface of an abrasive molding by an electron microscope; measuring pore diameter, particle diameter and other microstructures by an interceptive method; measuring the volume ratio of pores having a diameter of at least 0.5 μm; calculating the density of part of the abrasive molding, from which pores having a diameter of at least 0.5 μm; and then, calculating the relative density of the part from which pores having a diameter of at least 0.5 μm are excluded.

Preferable average particle diameter of the inorganic particles and preferable relative density of the abrasive molding, from which pores having a diameter of at least 0.5 μm are excluded, vary depending upon the particular inorganic particles. Thus, especially preferable are (i) an abrasive molding consisting essentially of silicon oxide particles with an average particle diameter in the range of 0.11 μm to 0.18 μm, and having a relative density in the range of 55% to 84%, provided that pores having a diameter of at least 0.5 μm are excluded from the molding; (ii) an abrasive molding consisting essentially of cerium oxide particles with an average particle diameter in the range of 0.10 μm to 0.20 μm, and having a relative density In the range of 48% to 76%, provided that pores having a diameter of at least 0.5 μm are excluded from the molding; and (iii) an abrasive molding consisting essentially of zirconium oxide particles with an average particle diameter in the range of 0.14 μm to 0.18 μm, and having a relative density in the range of 47% to 63%, provided that pores having a diameter of at least 0.5 μm are excluded from the molding.

Process for Making Abrasive Molding

The process for producing the abrasive molding of the present invention is not particularly limited, and various processes can be employed wherein a powdery inorganic material capable of producing the above-mentioned abrasive molding is molded under pressure and then, if desired, the molded product is sintered or fired or subjected to other treatment.

The molding under pressure of the powdery inorganic material includes, for example, press molding of a powdery inorganic material, carried out under conventional pressure conditions, and cast molding, injection molding and extrusion molding.

The powdery inorganic material may be subjected to a pretreatment for enhancing the moldability of the material. As examples of the pretreatment procedure, there can be mentioned a compacting procedure wherein the powdery inorganic material is compacted under various conditions, a pelletizing procedure wherein the powdery inorganic material is dissolved or dispersed in an aqueous medium and the thus-obtained aqueous solution or dispersion is pelletized by spray drying or rolling, an organic material-incorporating procedure wherein an organic material such as a binder is incorporated in the powdery inorganic material, and a wetting procedure wherein water is added to the inorganic material. The binder used Includes, for example, polyvinyl alcohol powder, a poly(butyl methacrylate) powder, potato starch and paraffin wax. These binders may be used either alone or in combination.

In the organic material-incorporating procedure, the inorganic material having incorporated therein an organic material such as a binder is preferably subjected to a degreasing treatment after the organic material-incorporated inorganic material is shaped into a molding, but before the final abrasive molding is obtained. For example, the degreasing treatment can be carried out by heating the organic material-incorporated inorganic material in the air atmosphere or in an inert gas atmosphere such as nitrogen, argon or helium under enhanced pressure, normal pressure or reduced pressure. In the wetting procedure, the water-added material is dried after the water-added material is shaped into a molding but before the molding is sintered. The shaping into an abrasive molding is conducted preferably by press molding under a pressure of 50 to 3,000 kg/cm$^2$.

A pore-forming agent may be incorporated in the powdery inorganic material to control the micropore structure of the abrasive molding according to the need. The pore-forming agent includes, for example, an powdery organic material and powdery carbon.

An as-shaped abrasive molding, especially, as-shaped abrasive molding from which a binder has been removed, generally has a poor mechanical strength. Hence, the as-shaped abrasive molding is preferably sintered or fired to enhance the mechanical strength and durability for polishing.

Sintering or firing of the as-shaped abrasive molding is carried out under various conditions. Appropriate sintering or firing conditions such as temperature, time, program and atmosphere may suitably be determined. The sintering temperature is preferably in the range of 700 to 1,500° C.

Thus, an abrasive molding having a mechanical strength enough for withstanding the polishing operation can be made by appropriately employing a procedure including, for example, heat-degreasing, sintering or firing, machining, chemical treatment or physical treatment, or a combination of these treatments.

Abrasive Disc

An abrasive disc is made by assembling at least one of the above-mentioned abrasive molding with a supporting auxiliary. The supporting auxiliary used is not particularly limited, and can be made of various materials and can be of various shapes. Suitable material and shape can be appropriately chosen depending upon the particular abrasive disc. The abrasive molding or moldings are fixed to the supporting auxiliary, for example, by an adhering procedure using an adhesive, or a procedure of fitting the abrasive moldings into recesses formed on the supporting auxiliary.

The number of abrasive molding fixed to a supporting auxiliary is not particularly limited, and may be either one or two or more. The number of abrasive molding is preferably at least two for the following reasons, although the invention is not bound thereto. When polishing is conducted by using an abrasive disc having two or more abrasive moldings fixed to a supporting auxiliary in an arrangement such that a polishing liquid applied is discharged through drainage conduits formed between adjacent abrasive moldings, the rate of polishing can be enhanced. Further, the abrasive moldings are brought into uniform contact with the entirety of a material to be polished, and uniform polishing can be effectively achieved. When an abrasive disc having a single abrasive molding fixed to a supporting auxiliary is used, a conduit for draining a polishing liquid is preferably formed on the polishing surface of the abrasive molding.

The shape of the abrasive molding is not particularly limited, and includes, for example, a columnar pellet having a circular cross-section, a square pillar shaped pellet having a triangular or quadrilateral cross-section, and a columnar pellet having a scallop-shaped cross-section, and hollow columnar pellets such as ring-shaped pellet. The size of the abrasive molding is also not particularly limited and can be appropriately chosen depending upon the supporting auxiliary.

The fashion by which abrasive moldings are arranged on a supporting auxiliary for constituting an abrasive disc is not particularly limited. For example, a plurality of small abrasive moldings are combined together to form an integrated moldings which are fitted to a supporting auxiliary, or a plurality of abrasive moldings are embedded in a large circular supporting auxiliary.

When a plurality of abrasive moldings are arranged on a supporting auxiliary, the configuration of polishing surfaces of the arranged abrasive moldings preferably conform to the polishing surface of a material to be polished. In this case, a supporting auxiliary having a surface configuration conforming to a material surface to be polished can be used. For example, when a material surface to be polished is flat, the abrasive moldings are fitted so that heights of polishing surfaces of the abrasive moldings from the surface of the supporting auxiliary are uniform over the entire polishing surfaces, and thus, the polishing surfaces of the abrasive moldings form a flat polishing surface. When a material surface to be polished is curved, the polishing surfaces of the arranged abrasive moldings preferably form a similarly curved surface. By such arrangement of abrasive moldings, a material surface to be polished can be brought into direct and uniform contact with the entire polishing surfaces of the abrasive moldings. Thus, maximum and uniform contact between the polishing surfaces of abrasive moldings and the surface of a material to be polished can be obtained.

The shape of abrasive disc can be such that the polishing surfaces of abrasive moldings form a surface conforming to a material surface to be polished, as mentioned above, and can be any shape of flat sheet, circular disc, ring-shape and column, provided that the polishing surfaces are brought into direct contact with the material surface to be polished, and the disc has an enough mechanical strength and can polish the material.

Polishing Process using Abrasive Disc

The polishing process using the above-mentioned abrasive disc is not particularly limited, and the shape of abrasive disc, polishing conditions and polishing liquid can be appropriately chosen. When a polishing liquid is used, conventional polishing liquids containing no loose abrasive grain can be employed, such as an aqueous solution and an organic solution, which do not contain ordinary abrasive grains including, for example, diamond, aluminum oxide, silicon oxide, cerium oxide, zirconium oxide, manganese oxide, titanium oxide, magnesium oxide, iron oxide, chromium oxide and silicon carbide. If desired, the polishing liquid containing no loose abrasive grain may contain a polishing promoter such as an acid, an alkali, a chelating agent, an oxidizing agent and a reducing agent. Thus, as specific examples of the polishing liquid containing no loose abrasive grain, there can be mentioned water; an aqueous solution containing an inorganic acid such as hydrochloric acid, sulfuric acid or nitric acid; an aqueous solution containing an organic acid such as formic acid, acetic acid, oxalic acid, malonic acid, quinaldinic acid, citric acid, tartaric acid or succinic acid; an aqueous solution containing an alkali metal hydroxide such as lithium hydroxide, sodium hydroxide, potassium hydroxide or rubidium hydroxide; an aqueous solution containing an alkaline earth metal hydroxide such as calcium hydroxide; an aqueous ammonia solution; an aqueous solution containing a chelating agent such as ethylenediaminetetraacetato complex (EDTA); an aqueous solution containing an oxidizing agent such as hydrogen peroxide or potassium permanganate; and an aqueous solution containing a reducing agent such as sodium sulfite or potassium sulfite. Of these, an aqueous solution of an alkali metal hydroxide or an alkaline earth metal hydroxide, and water.

These polishing liquids are used at a temperature lower than the boiling point thereof. The flow rate of polishing liquid, the polishing pressure, the relative speed between the material to be polished and the abrasive disc (namely, the rate of rotation of the abrasive disc), and other polishing conditions are not particularly limited and can be appropriately chosen.

In the polishing process using the above-mentioned abrasive disc, polishing is effected without use of a polishing cloth. The abrasive discussed is more durable, i.e., has a longer operable life, than a polishing cloth. Thus, the frequency of exchange is reduced and the efficiency of polishing is enhanced, as compared with the conventional polishing process using a polishing cloth.

A polishing liquid containing no loose abrasive grain is used in the polishing process using the abrasive disc of the invention, and hence, the problem of waste liquor disposal can be mitigated or avoided.

The material to be polished or chemicomechanically polished by the abrasive disc of the invention includes, for example, substrate materials such as a semiconductor substrate, an oxide substrate, a glass substrate and silica glass substrate, magnetic head materials, glass materials, metal materials, optical materials such as lens, and building materials such as building stones. The abrasive disc is characterized by giving a polished surface of improved smoothness and flatness, the corner portions thereof are not excessively abraded, and thus, the abrasive disc especially advantageously employed in CMP process for substrates including a semiconductor substrate.

The invention will now be described specifically by the following examples that by no means limit the scope of the invention.

Characteristics of abrasive moldings and abrasive discs were determined by the following method.

(1) Average Particle Diameter of Inorganic Particles ($\mu$m)

Average particle diameter of inorganic particles constituting an abrasive molding was determined as follows. An abrasive molding was embedded in an acrylic resin and then cut with a microtome. The cut surface of the abrasive molding was observed by a scanning electron microscope "ISI DS-130" available from Akashi Seisakusho K. K., Japan). The average particle diameter was determined on electron micrographic photographs with various magnifications of the observed particles by an interseptive method.

(2) Relative Density (Q; %) of Abrasive Molding

Relative density (Q) of part of an abrasive molding, from which pores having a diameter of at least 0.5 $\mu$m were excluded, was determined as follows. A surface of an abrasive molding was observed by scanning electron microscope "ISI DS-130" available from Akashi Seisakusho K. K., Japan), and a distribution of pore diameters was determined by an interceptive method. A relative pore volume ratio (PV), namely, a ratio of the volume of pores having a diameter of at least 0.5 $\mu$m to the total volume of the abrasive molding was calculated. Density (DD) of part of the abrasive molding, from which pores having a diameter of at least 0.5 $\mu$m were excluded, was calculated from the formula:

$$DD=W/\{(1-PV)\times V\}$$

wherein W is weight (g) of sample abrasive molding, and V is volume (ml) of sample abrasive molding, and PV is pore volume ratio, mentioned above. Then, true density (DT) was calculated, and the relative density (Q) of part of an abrasive molding, from which pores having a diameter of at least 0.5 $\mu$m were excluded, was calculated from the formula:

$$Q\ (\%)=(DD/DT)\times 100$$

(3) Surface State of Polished Material

The surface of polished material was observed by an optical microscope, and the evaluation results were expressed by the following two ratings.

Rating A: the surface was very smooth, and defects such as scratches and pits were not found.

Rating B: the surface was not smooth, and surface defects such as scratches and pits were found.

(4) Abrasion of Abrasive Molding

Abrasion of an abrasive molding was observed on the polished surface of a polished material, and was expressed by the following two ratings.

Rating A: abrasion of abrasive molding was minor, and a very minor amount of inorganic particles were fallen off during polishing.

Rating B: abrasion of abrasive molding was large, and a salient amount of inorganic particles were fallen off during polishing.

(5) Surface Roughness (Ra) of Polished Surface

The surface precision of a polished surface was expressed by center line average surface roughness (Ra) of the polished surface. The surface roughness was measured by a repulsion force-determining method according to a contact mode by using an atomic force microscope (AFM) "SPI3600" available form SII Co. The measurement was conducted on three regions each having a size of 5 $\mu$m×5 $\mu$m on the polished surface, and the results were expressed by an average value of the three values of center line surface roughness.

Preparation of Abrasive Moldings

Using powdery raw materials having a composition shown in Table 1, fifteen kinds of abrasive moldings were made as follows. Each powdery raw material was incorporated with a poly(vinyl alcohol) powder, a poly(butyl methacrylate) powder, potato starch and/or a paraffin wax as a binder; the thus-mixed powder was press-molded under a pressure of 50 to 3,000 kg/cm$^2$ to form a molding; and the as-made molding was sintered at a temperature of 700 to 1,500° C.

Average particle diameter ($\mu$m) of inorganic particles constituting each abrasive molding, and relative density (%) of part of each abrasive molding from which pores having a diameter of at least 0.5 $\mu$m were excluded were determined. The results are shown in Table 1.

TABLE 1

| Abrasive molding No. | 1 | 2 | 3 | 4 | 5 | 6 |
|---|---|---|---|---|---|---|
| Composition of raw material powder | $CeO_2$ | $CeO_2$ | $CeO_2$ | $CeO_2$ | $CeO_2$ | $CeO_2$ |
| Properties of abrasive moldings | | | | | | |
| Average particle diameter ($\mu$m) | 0.11 | 0.14 | 0.18 | 0.32 | 0.07 | 0.23 |
| Relative density (%)*1 | 55 | 72 | 84 | 81 | 41 | 92 |
| **Abrasive molding No.** | **7** | **8** | **9** | **10** | **11** | **12** |
| Composition of raw material powder *2 | Y-Zr | Y-Zr | Y-Zr | Y-Zr | Y-Zr | Y-Zr |
| Properties of abrasive moldings | | | | | | |
| Average particle diameter ($\mu$m) | 0.1 | 0.15 | 0.2 | 0.37 | 0.08 | 0.29 |
| Relative density (%)*1 | 48 | 62 | 76 | 78 | 42 | 94 |
| **Abrasive molding No.** | | | **13** | **14** | **15** | |
| Composition of raw material powder | | | $SiO_2$ | $SiO_2$ | $SiO_2$ | |
| Properties of abrasive moldings | | | | | | |
| Average particle diameter ($\mu$m) | | | 0.14 | 0.18 | 0.07 | |
| Relative density (%)*1 | | | 47 | 63 | 32 | |

Note,
*1: Relative density of part of abrasive molding from which pores having a diameter of at least 0.5 $\mu$m were excluded.
*2: Y—Zr = solid solution of 3 mol % $Y_2O_3$ in $ZrO_2$.

POLISHING BY ABRASIVE MOLDINGS

Examples 1 to 3 and Comparative Examples 1 to 4

Using materials to be polished (square plate having a size of 45 mm×45 mm, shown in Table 2), and abrasive moldings, shown in Table 2, a polishing test was conducted as follows.

Five abrasive moldings made of $CeO_2$, each having a square prism shape having a square cross-section with a size of 90 mm×90 mm×10 mm (thickness) and four abrasive moldings made of $CeO_2$, each having a triangular prism shape having a right-angled equilateral triangular cross-section with two short sides of 90 mm and having a thickness of 10 mm were fitted to a lower disc (diameter 300 mm) of a polishing apparatus "PLANOPOL/PEDEMAX 2" available from Struers Co. in a manner such that the polishing surfaces of the nine abrasive moldings form a flat polishing surface. Each material to be polished having a square form with a size of 45 mm×45 mm was polished by the nine abrasive moldings-fitted disc at a lower disc revolution of 300 rpm and a working pressure of100 g/cm$^2$, while the following polishing liquid was supplied at a rate of 200 ml/min.

(i) Polishing liquid "a": distilled water, pH: 6–7, room temperature;

(ii) Polishing liquid "b": an aqueous KOH solution, pH: 10.5, room temperature (iii) Polishing liquid "c": a slurry containing 5% by weight of $CeO_2$ having an average particle diameter of 0.2 $\mu$m, pH: 6–7, room temperature;

(iv) Polishing liquid "d": a slurry containing 20% by weight of colloidal silica having an average particle diameter of 0.08 $\mu$m, pH: 10.5, room temperature.

Surface state (surface smoothness) of the polished surfaces, surface roughness of the polished surfaces, and the abrasion of the abrasive moldings were evaluated. The results are shown In Table 2.

TABLE 2

| Working Examples *1 | E1 | E2 | E3 | CE1 | CE2 | CE3 | CE4 |
|---|---|---|---|---|---|---|---|
| Abrasive molding No. | 1 | 2 | 3 | 4 | 5 | 6 | 2 |
| Material polished *2 | SiG | SiG | SiG | SiG | SiG | SiG | SiG |
| Polishing liquid | a | a | a | a | a | a | c |
| Evaluation results | | | | | | | |
| Abrasion of abrasive molding | A | A | A | A | B | A | A |
| State of polished surface | A | A | A | A | B | B | A |
| Surface Roughness of polished surface (nm)*3 | 0.11 | 0.12 | 0.15 | 0.31 | — | — | 0.51 |

Note,
*1: E = Example, CE = Comparative Example
*2: Material polished: SiG = crystalline silica glass
*3: Center line average surface roughness (Ra; nm)

In Examples 1 to 3, center line average surface roughness (Ra) of the polished surface was in the range of 0.11 to 0.15 nm, i.e., very good. In contrast, in Comparative Example 1, the abrasive molding had a large average particle diameter, and thus, center line average surface roughness (Ra) of the polished surface was very bad. In Comparative Example 2, the abrasive molding was abraded to a great extent and the polished surface had defects due to particles fallen therefrom, and good polishing could not be effected. In comparative Example 3, although abrasion of the abrasive molding was minor, the polished surface had many defects. In Comparative Example 4 using a polishing liquid containing $CeO_2$ grains, abrasion of the abrasive molding and state of the polished surface were satisfactory, but center line average surface roughness (Ra) of the polished surface was undesirably large.

Examples 4 to 6 and Comparative Examples 5 to 8

Using materials to be polished (crystalline silica glass) abrasive moldings (solid solution of 3 mol % $Y_2O_3$ in $ZrO_2$) and a polishing liquid, shown in Table 3, a polishing test was conducted by substantially the same procedure as mentioned in Examples 1 to 3 and Comparative Examples 1 to 4.

Surface state (surface smoothness) of the polished surfaces, surface roughness of the polished surfaces, and the abrasion of the abrasive moldings were evaluated. The results are shown in Table 3.

TABLE 3

| Working Examples *1 | E4 | E5 | E6 | CE5 | CE6 | CE7 | CE8 |
|---|---|---|---|---|---|---|---|
| Abrasive molding No. | 7 | 8 | 9 | 10 | 11 | 12 | 8 |
| Material polished *2 | SiG | SiG | SiG | SiG | SiG | SiG | SiG |
| Polishing liquid | a | a | a | a | a | a | c |
| Evaluation results | | | | | | | |
| Abrasion of abrasive molding | A | A | A | A | B | A | A |
| State of polished surface | A | A | A | A | B | B | A |
| Surface Roughness of polished surface (nm)*3 | 0.13 | 0.09 | 0.17 | 0.39 | — | — | 0.57 |

Note,
*1: E = Example, CE = Comparative Example
*2: Material polished: SiG = crystalline silica glass
*3: Center line average surface roughness (Ra; nm)

In Examples 4 to 6, center line average surface roughness (Ra) of the polished surface was in the range of 0.09 to 0.17 nm, i.e., very good, which was similar to in Examples 1 to 3. In contrast, in Comparative Example 5, the abrasive molding had a large average particle diameter, and thus, center line average surface roughness (Ra) of the polished surface was very bad, which was similar to in Comparative Example 1. In Comparative Example 6, the abrasive molding was abraded to a great extent, which was similar to in Comparative Example 2, and the polished surface had defects due to particles fallen therefrom, and good polishing could not be effected. In comparative Example 7, although abrasion of the abrasive molding was minor, the polished surface had many defects, which was similar to in Comparative Example 3. In Comparative Example 8 using a polishing liquid containing $CeO_2$ grains, abrasion of the abrasive molding and state of the polished surface were satisfactory, but center line average surface roughness (Ra) of the polished surface was undesirably large, which was similar to in Comparative Example 4.

Examples 7 and 8 and Comparative Examples 9 and 10

Using materials to be polished (silicon), abrasive moldings ($SiO_2$) and a polishing liquid containing a soluble polishing promoter, shown in Table 4, a polishing test was conducted by substantially the same procedure as mentioned in Examples 1 to 3 and Comparative Examples 1 to 4, wherein the working pressure was changed to 500 g/cm$^2$.

Surface state (surface smoothness) of the polished surfaces, surface roughness of the polished surfaces, and the abrasion of the abrasive moldings were evaluated. The results are shown in Table 4.

TABLE 4

| Working Examples *1 | E7 | E8 | CE9 | CE10 |
|---|---|---|---|---|
| Abrasive molding No. | 13 | 14 | 15 | 13 |
| Material polished | Si | Si | Si | Si |
| Polishing liquid | b | b | b | d |
| Evaluation results: | | | | |
| Abrasion of abrasive molding | A | A | B | A |
| State of polished surface | A | A | B | A |
| Surface Roughness of polished surface (nm)*2 | 0.18 | 0.22 | — | 0.45 |

Note,
*1: E = Example, CE = Comparative Example
*2: Center line average surface roughness (Ra; nm)

In Examples 7 and 8, center line average surface roughness (Ra) of the polished surface was 0.18 nm and 0.22 nm, i.e., very good, which was similar to in Examples 1 to 3. In contrast, in Comparative Example 9, the abrasive molding was abraded to a greater extent than that in Comparative Examples 2 and 6, and thus, polishing could not be substantially effected. In comparative Example 10 using a polishing liquid containing colloidal silica, abrasion of the abrasive molding and state of the polished surface were satisfactory, but center line average surface roughness (Ra) of the polished surface was undesirably large, which was similar to in Comparative Examples 4 and 8.

By using the abrasive molding of the present invention, polishing can be conducted with a polishing liquid containing no loose abrasive grain, and thus, the polishing cost is reduced and the problem of waste polishing liquid is mitigated; and further, polishing of substrate materials and optical materials can be conducted with a high efficiency to give a smooth polished surface of the same level as or higher level than those of the conventional polishing processes using a polishing pad.

What is claimed is:

1. An abrasive molding for polishing a material to be polished by using a polishing liquid containing no loose abrasive grain, said molding consisting essentially of inorganic particles having an average particle diameter in the range of 0.005 μm to 0.3 μm, and said molding having a relative density in the range of 45% to 90%, provided that pores having a diameter of at least 0.5 μm are excluded from the molding.

2. The abrasive molding according to claim 1, wherein the polishing liquid is water or an aqueous solution of an alkali metal hydroxide.

3. The abrasive molding according to claim 1, wherein the inorganic particles are finely divided particles of at least one inorganic substance selected from the group consisting of silicon oxide, cerium oxide and zirconium oxide.

4. The abrasive molding according to claim 1, wherein the material to be polished is crystalline silica or silicon.

5. An abrasive molding for polishing a material to be polished by using a polishing liquid containing no loose abrasive grain, said molding consisting essentially of silicon oxide particles having an average particle diameter in the range of 0.11 μm to 0.18 μm, and said molding having a relative density in the range of 55% to 84%, provided that pores having a diameter of at least 0.5 μm are excluded from the molding.

6. An abrasive molding for polishing a material to be polished by using a polishing liquid containing no loose abrasive grain, said molding consisting essentially of cerium oxide particles having an average particle diameter in the range of 0.10 μm to 0.20 μm, and said molding having a relative density in the range of 48% to 76%, provided that pores having a diameter of at least 0.5 μm are excluded from the molding.

7. An abrasive molding for polishing a material to be polished by using a polishing liquid containing no loose abrasive grain, said molding consisting essentially of zirconium oxide particles having an average particle diameter in the range of 0.14 μm to 0.18 μm, and said molding having a relative density in the range of 47% to 63%, provided that pores having a diameter of at least 0.5 μm are excluded from the molding.

8. An abrasive disc for polishing a material to be polished by using a polishing liquid containing no loose abrasive grain, said abrasive disc comprising at least one abrasive molding fixed to a supporting auxiliary; said abrasive molding consisting essentially of inorganic particles having an average particle diameter in the range of 0.005 μm to 0.3 μm, and said molding having a relative density in the range of 45% to 90%, provided that pores having a diameter of at least 0.5 μm are excluded from the molding.

9. The abrasive disc according to claim 8, wherein the polishing liquid is water or an aqueous solution of an alkali metal hydroxide.

10. The abrasive molding according to claim 8, wherein the inorganic particles are finely divided particles of at least one inorganic substance selected from the group consisting of silicon oxide, cerium oxide and zirconium oxide.

11. The abrasive molding according to claim 8, wherein the material to be polished is crystalline silica or silicon.

12. An abrasive disc for polishing a material to be polished by using a polishing liquid containing no loose abrasive grain, said abrasive disc comprising at least one abrasive molding fixed to a supporting auxiliary; said abrasive molding consisting essentially of silicon oxide particles having an average particle diameter in the range of 0.11 μm to 0.18 μm, and said molding having a relative density in the range of 55% to 84%, provided that pores having a diameter of at least 0.5 μm are excluded from the molding.

13. An abrasive disc for polishing a material to be polished by using a polishing liquid containing no loose abrasive grain, said abrasive disc comprising at least one abrasive molding fixed to a supporting auxiliary; said abrasive molding consisting essentially of cerium oxide particles having an average particle diameter in the range of 0.10 μm to 0.20 μm, and said molding having a relative density in the range of 48% to 76%, provided that pores having a diameter of at least 0.5 μm are excluded from the molding.

14. An abrasive disc for polishing a material to be polished by using a polishing liquid containing no loose abrasive grain, said abrasive disc comprising at least one abrasive molding fixed to a supporting auxiliary; said abrasive molding consisting essentially of zirconium oxide particles having an average particle diameter in the range of 0.14 μm to 0.18 μm, and said molding having a relative density in the range of 47% to 63%, provided that pores having a diameter of at least 0.5 μm are excluded from the molding.

* * * * *